US009685718B1

(12) United States Patent
Wang

(10) Patent No.: US 9,685,718 B1
(45) Date of Patent: Jun. 20, 2017

(54) CONNECTOR STRUCTURE

(71) Applicant: P-TWO INDUSTRIES INC., Taoyuan (TW)

(72) Inventor: Chien-Chun Wang, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days.

(21) Appl. No.: 15/292,131

(22) Filed: Oct. 13, 2016

(30) Foreign Application Priority Data

Jul. 29, 2016 (TW) ..... 105211619 U

(51) Int. Cl.

| | |
|---|---|
| ***H01R 12/00*** | (2006.01) |
| ***H01R 12/52*** | (2011.01) |
| ***H01R 12/71*** | (2011.01) |
| ***H01R 12/57*** | (2011.01) |
| ***H01R 13/6474*** | (2011.01) |
| ***H01R 13/6594*** | (2011.01) |

(52) U.S. Cl.
CPC ..... *H01R 12/52* (2013.01); *H01R 12/57* (2013.01); *H01R 12/716* (2013.01); *H01R 13/6474* (2013.01); *H01R 13/6594* (2013.01)

(58) Field of Classification Search
CPC ..... H01R 12/716; H01R 12/57; H01R 12/52
USPC ..... 439/79, 74, 626, 65, 607.4, 607.55, 629, 439/638
See application file for complete search history.

(56) References Cited

U.S. PATENT DOCUMENTS 5,688,130 A * 11/1997 Huang ..... H01R 12/716 439/541.5
6,974,344 B2 * 12/2005 Comerci ..... H01R 23/661 439/329
8,070,512 B2 * 12/2011 Xuan ..... H01R 13/506 439/541.5
8,721,350 B2 * 5/2014 Liu ..... H01R 12/73 439/65
8,851,902 B2 * 10/2014 Shifris ..... H01R 13/6658 439/65
8,894,433 B2 * 11/2014 Little ..... H01R 12/7005 439/378

(Continued)

FOREIGN PATENT DOCUMENTS

CN 102004522 A 4/2011
TW M502975 U 6/2015

*Primary Examiner* — Abdullah Riyami
*Assistant Examiner* — Nader Alhawamdeh
(74) *Attorney, Agent, or Firm* — Winston Hsu

(57) ABSTRACT

A connector structure includes a first connecting component, a rigid circuit board and a second connecting component. The first connecting component includes a first main body whereon a slot is formed, and a plurality of first terminals disposed on the first main body. Each first terminal includes a contacting portion extending into the slot, and a welding portion protruding out of the first main body. The rigid circuit board is assembled into the slot and contacts the contacting portions of the plurality of first terminals. The second connecting component is installed on the rigid circuit board and electrically connected to the plurality of first terminals. The second connecting component includes a second main body, a shielding plate, a plurality of second terminals and a metal shell. The second connecting component, the rigid circuit board and the first connecting component are cooperatively formed in a reverse L-shaped structure.

20 Claims, 9 Drawing Sheets

(56) References Cited

U.S. PATENT DOCUMENTS

| | | | | |
|---|---|---|---|---|
| 8,961,231 | B2 * | 2/2015 | Wright | H05K 3/368 439/350 |
| 8,968,008 | B2 * | 3/2015 | Chang | H01R 12/52 439/74 |
| 2006/0234530 | A1 * | 10/2006 | Chung | H05K 3/341 439/79 |
| 2007/0197056 | A1 * | 8/2007 | Huang | G06F 1/185 439/74 |
| 2008/0171454 | A1 * | 7/2008 | Liu | H01R 12/58 439/74 |
| 2009/0046437 | A1 * | 2/2009 | Hsieh | G06F 1/185 361/752 |
| 2009/0233466 | A1 * | 9/2009 | Lee | H05K 1/141 439/74 |
| 2009/0253299 | A1 * | 10/2009 | Zhang | H01R 13/65802 439/607.55 |
| 2013/0309879 | A1 * | 11/2013 | Chang | H01R 12/52 439/74 |
| 2016/0211593 | A1 * | 7/2016 | Tsai | H01R 25/006 |
| 2016/0352049 | A1 * | 12/2016 | Long | H01R 13/659 |
| 2016/0359284 | A1 * | 12/2016 | Hsu | H01R 27/02 |

* cited by examiner

CONNECTOR STRUCTURE

BACKGROUND OF THE INVENTION

1. Field of the Invention

The present invention relates to a connector structure, and more particularly, to a connector structure applied for high frequency signal transmission.

2. Description of the Prior Art

With rapid development of electronic industries and multimedia application, data transmission between electrical appliances is increasing gradually. Besides expanding transmission bandwidth, the current trend is towards to utilize electrical connectors with high frequency signal transmission. The need for standardization in computer related interfaces, as well as the need for high-speed communication interfaces, leads to the development of the universal serial bus (USB) interface. More recently, the USB Type-C connector has emerged as a USB-type connector having a relatively compact size, ultrahigh data transmission speed, and being configured so that the USB Type-C connector can be coupled without regard to plug orientation and/or cable direction, for extensive applications on different electronic devices. Furthermore, because super speed signal terminals of the USB type-C connector, when operating, other electronic components might be interfered by the electromagnetic waves, electromagnetic interference (EMI) proof function is necessary and usually achieved by grounding.

Please refer to FIG. 1. FIG. 1 is a sectional diagram of a conventional USB Type-C connector 1 in the prior art. The USB Type-C connector 1 includes a plastic housing 11, a shell 12, upper terminals 13, lower terminals 14, and a grounding plate 15. The plastic housing 11 includes a base portion 111 and a tongue portion 112 extending from the base portion 111. The grounding plate 15 is embedded inside the tongue portion 112, and the upper terminals 13 and the lower terminals 14 are respectively disposed on an upper surface and a lower surface of the tongue portion 112. The shell 12 surrounds the tongue portion 112 to form a jack 16. The electromagnetic interference between the upper terminals 13 and the lower terminals 14 can be prevented by the grounding plate 15, so as to achieve stable high frequency signal transmission. A relative position and a pitch of an upper pin 131 of the upper terminal 13 and a lower pin 141 of the lower terminal 14 have to cooperate with layout of a circuit board whereon the USB Type-C connector 1 is installed.

A height difference between the jack 16 of the USB Type-C connector 1 and the circuit board needs to be adjusted due to limitation of mechanical space inside the electrical appliances. It is a common practice to increase lengths of an upper vertical portion 132 of the upper terminal 13 and a lower vertical portion 142 of the lower terminal 14 and to heighten the base portion 111 of the plastic housing 11, so as to increase the height difference between the jack 16 of the USB Type-C connector 1 and the circuit board. However, it brings variation and instability of characteristic impedance of front and rear ends of the USB Type-C connector 1, which affects efficiency of high frequency signal transmission.

SUMMARY OF THE INVENTION

Therefore, an objective of the present invention is to provide a connector structure applied for high frequency signal transmission, for solving the aforementioned problem of variation and instability of characteristic impedance of front and rear ends of a conventional USB Type-C connector, resulting in affecting efficiency of high frequency signal transmission.

In order to achieve the aforementioned objective, the present invention discloses a connector structure including a first connecting component, a rigid circuit board and a second connecting component. The first connecting component includes a first main body whereon a slot is formed, and a plurality of first terminals disposed on the first main body. Each first terminal includes a contacting portion extending into the slot, and a welding portion connected to the contacting portion and protruding out of the first main body. The rigid circuit board is assembled into the slot of the first main body. The rigid circuit board includes an inserting portion inserting into the slot of the first main body, and a plurality of first contacts is formed on the inserting portion and contacts the contacting portions of the plurality of first terminals respectively. The rigid circuit board further includes a supporting portion connected to the inserting portion, and a plurality of second contacts is formed on the supporting portion and electrically connected to the plurality of first contacts respectively. The second connecting component is installed on the supporting portion of the rigid circuit board. The second connecting component includes a second main body including a tongue plate having an upper surface and a lower surface opposite to each other, a shielding plate disposed in the tongue plate and located between the upper surface and the lower surface of the tongue plate, a plurality of second terminals disposed on the upper surface and the lower surface of the tongue plate and electrically connected to the plurality of second contacts, and a shell disposed around the tongue plate and defining a connecting chamber. An opening is formed on a side of the connecting chamber.

The connector structure of the present invention utilizes the rigid circuit board to replace vertical extending parts of upper and lower terminals of the conventional USB Type-C connector and utilizes the first connecting component whereon the rigid circuit board is inserted to replace pins of upper and lower terminals of the conventional USB Type-C connector. Because the rigid circuit board has controllable characteristic impedance, it can solve the problem of the conventional USB Type-C connector with instable high frequency signal transmission due to variation of characteristic impedance.

These and other objectives of the present invention will no doubt become obvious to those of ordinary skill in the art after reading the following detailed description of the preferred embodiment that is illustrated in the various figures and drawings.

DETAILED DESCRIPTION

In order to illustrate technical specifications and structural features as well as achieved purposes and effects of the present invention, relevant embodiments and figures are described as follows.

Figure 1:
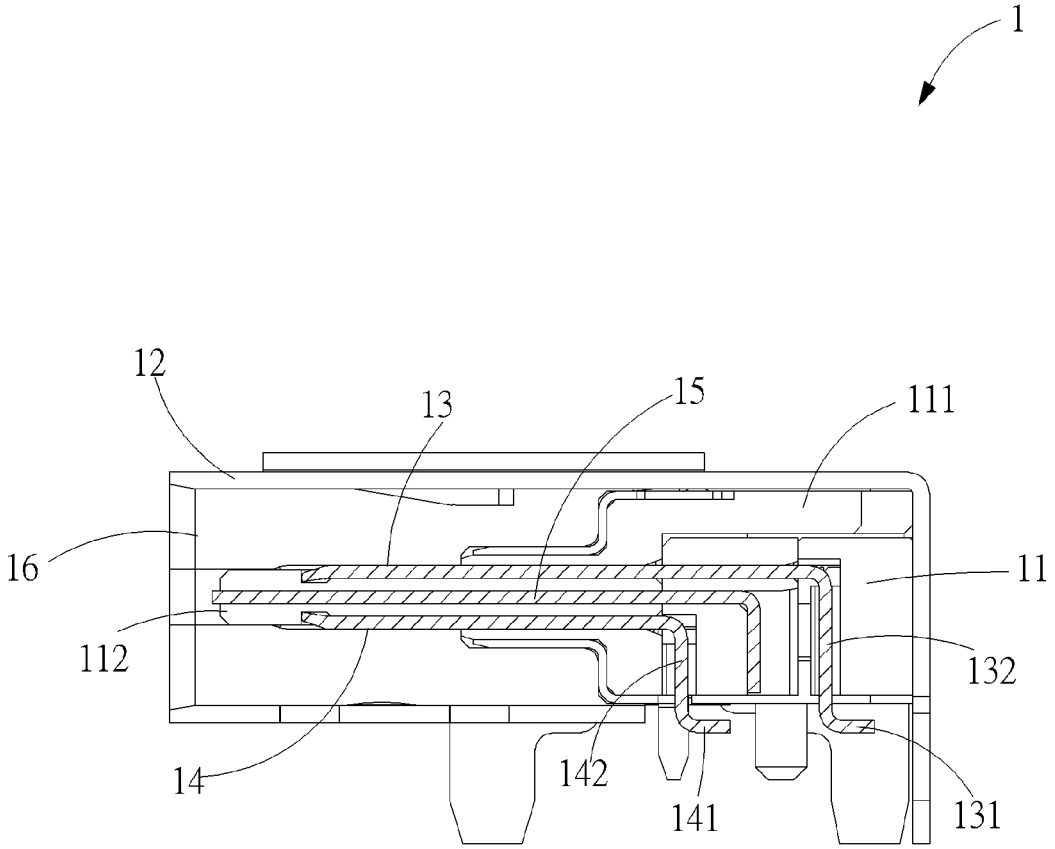
FIG. 1 PRIOR ART
FIG. 1 is a sectional diagram of a conventional USB Type-C connector in the prior art.
Figure 2:
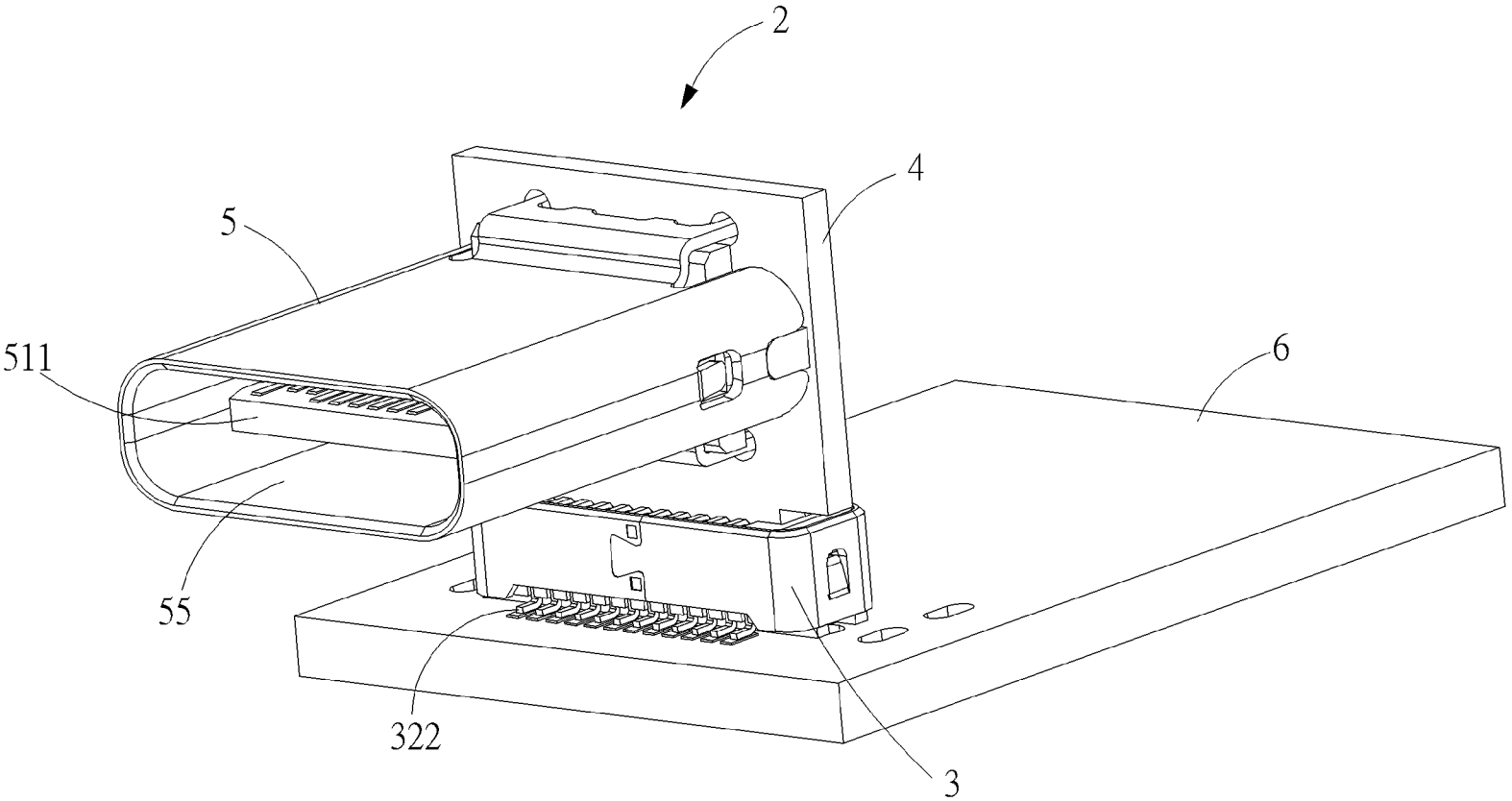
FIG. 2 is a schematic diagram of a connector structure installed on a circuit board according to an embodiment of the present invention.
Figure 3:
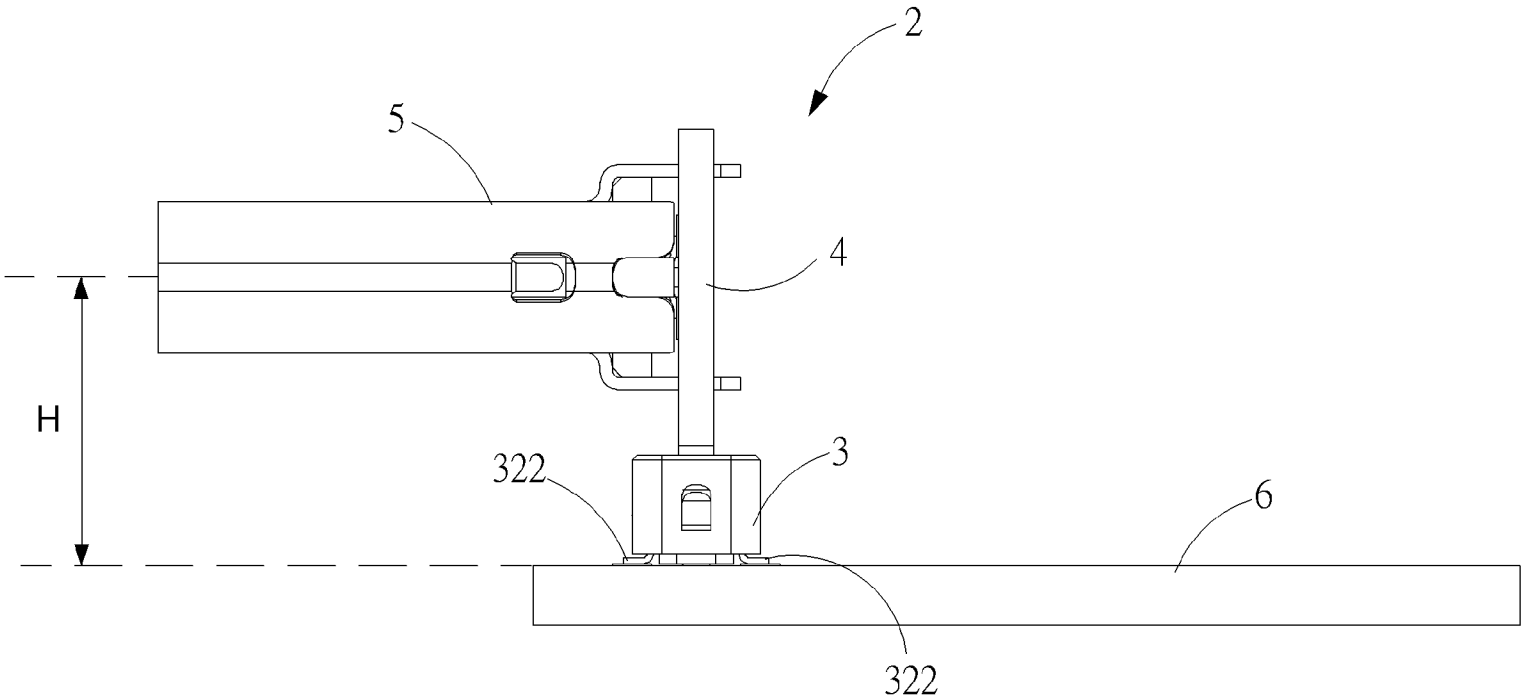
FIG. 3 is a lateral view of the connector structure according to the embodiment of the present invention.
Figure 4:
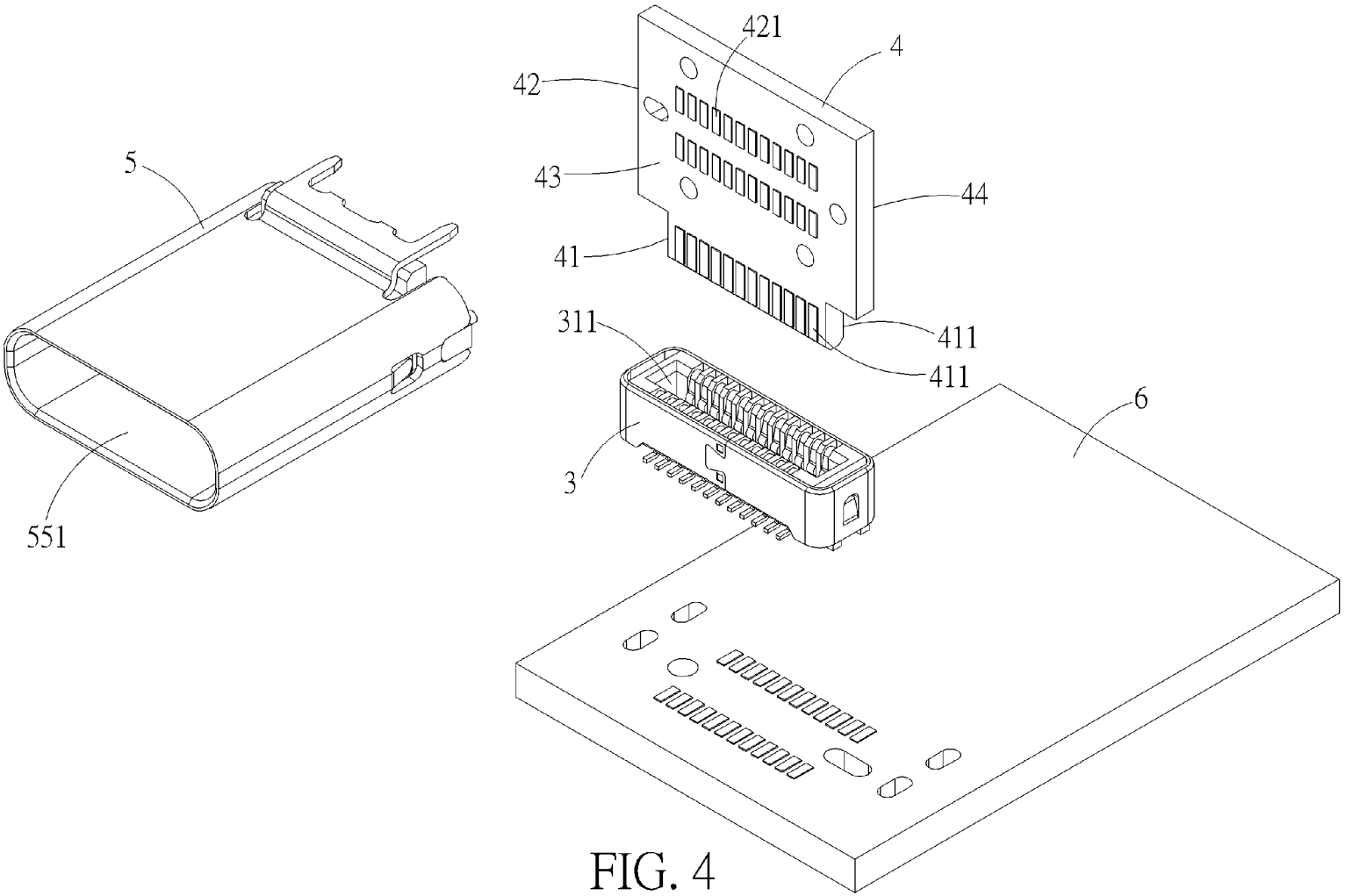
FIG. 4 is an exploded diagram of the connector structure according to the embodiment of the present invention.
Figure 5:
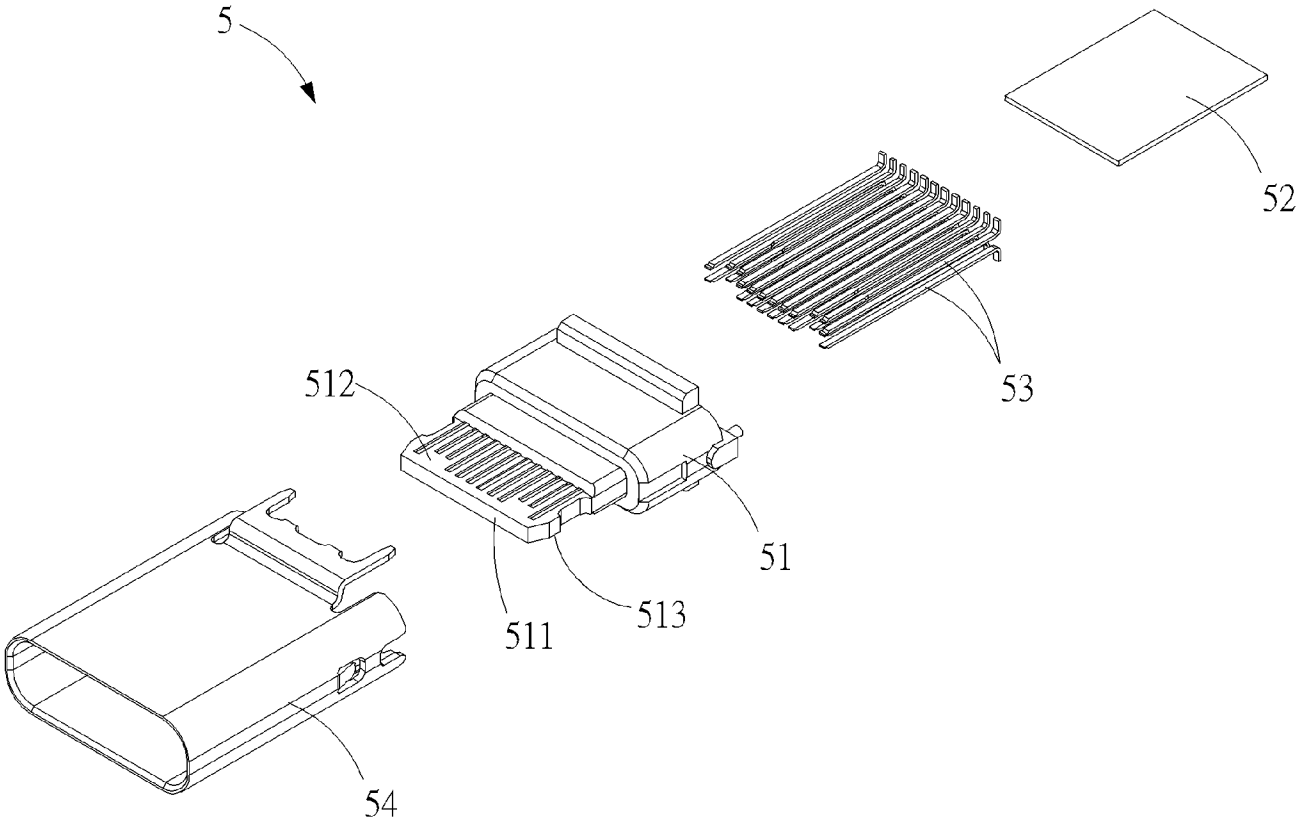
FIG. 5 is an exploded diagram of a second connecting component of the connector structure according to the embodiment of the present invention.
Figure 6:
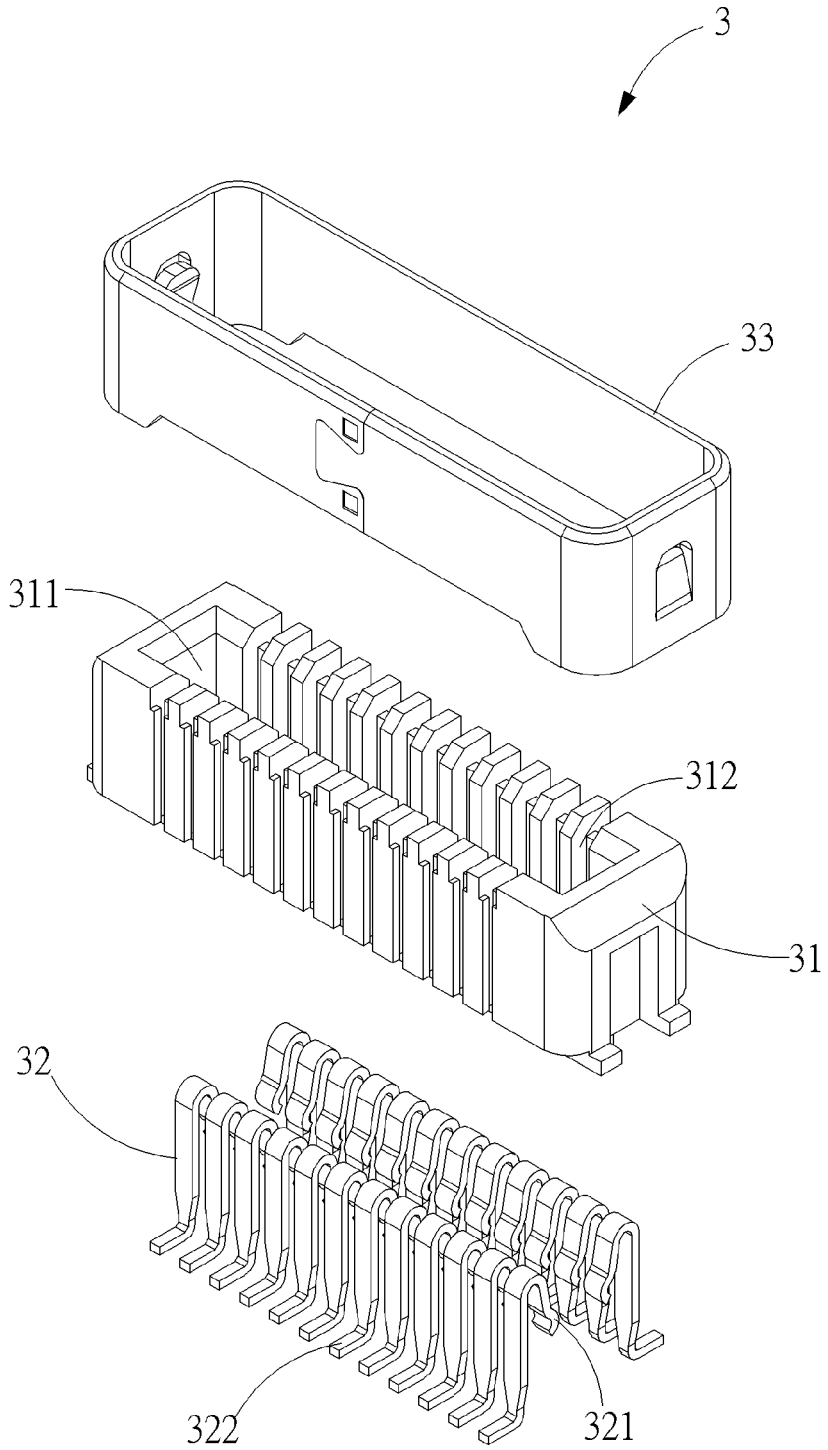
FIG. 6 is an exploded diagram of a first connecting component of the connector structure according to the embodiment of the present invention.

Please refer to FIG. 2 to FIG. 6. FIG. 2 is a schematic diagram of a connector structure 2 installed on a circuit board 6 according to an embodiment of the present invention. FIG. 3 is a lateral view of the connector structure 2 according to the embodiment of the present invention. FIG. 4 is an exploded diagram of the connector structure 2 according to the embodiment of the present invention. FIG. 5 is an exploded diagram of a second connecting component 5 of the connector structure 2 according to the embodiment of the present invention. FIG. 6 is an exploded diagram of a first connecting component 3 of the connector structure 2 according to the embodiment of the present invention. The connector structure 2 includes the first connecting component 3, a rigid circuit board 4 and the second connecting component 5. The first connecting component 3 can be welded on the circuit board 6. The second connecting component 5 can connect with a butting connector, which is not shown in figures.

The first connecting component 3 includes a first main body 31 whereon a slot 311 and a plurality of terminal grooves 312 are formed. The plurality of terminal grooves 312 is communicated with the slot 311, and a plurality of first terminals 32 is assembled inside the plurality of terminal grooves 312. Each first terminal 32 includes a contacting portion 321 extending into the slot 311, and a welding portion 322 connected to the contacting portion 321 and protruding out of the first main body 31 for welding on the circuit board 6. The plurality of first terminals 32 also can be fixed on the first main body 31 in an insert molding manner. It depends on practical demands. For enhancing efficiency of signal transmission, the first connecting component 3 can further include a shielding shell 33 disposed around the first main body 31 for preventing electromagnetic interference (EMI).

The rigid circuit board 4 is assembled into the slot 311 of the first main body 31. The rigid circuit board 4 includes an inserting portion 41 and a supporting portion 42. The inserting portion 41 is inserted into the slot 311 of the first main body 31, and a plurality of first contacts 411 is formed on the inserting portion 41 and for contacting the contacting portions 321 of the plurality of first terminals 32, respectively. The supporting portion 42 is connected to the inserting portion 41, and a plurality of second contacts 421 is formed on the supporting portion 42 and electrically connected to the plurality of first contacts 411, respectively. In this embodiment, the rigid circuit board 4 includes a front surface 43, a rear surface 44, and a ground layer (not shown in figures) disposed between the front surface 43 and the rear surface 44 and embedded inside the rigid circuit board 4 for providing the grounding function, so as to achieve stable high frequency signal transmission. The plurality of second contacts 421 is disposed on the front surface 43 of the supporting portion 42, and the plurality of first contacts 411 is disposed on the front surface 43 and the rear surface 44 of the inserting portion 41.

The second connecting component 5 is installed on the supporting portion 42 of the rigid circuit board 4, and the second connecting component 5 includes a second main body 51, a shielding plate 52, a plurality of second terminals 53 and a shell 54. The second main body 51 includes a tongue plate 511 having an upper surface 512 and a lower surface 513 opposite to each other. The shielding plate 52 is disposed in the tongue plate 511 and located between the upper surface 512 and the lower surface 513 of the tongue plate 511. The plurality of second terminals 53 is disposed on the upper surface 512 and the lower surface 513 of the tongue plate 511 and is electrically connected to the plurality of second contacts 421. For example, the plurality of second terminals 53 can be welded with the plurality of second contacts 421 for electrical conduction. The shell 54 can be a metal shell and is disposed around the tongue plate 511 to define a connecting chamber 55, and an opening 551 is formed on a side of the connecting chamber 55.

In this embodiment, the second connecting component 5, the rigid circuit board 4 and the first connecting component 3 are cooperatively formed in a reverse L-shaped structure having a horizontal part corresponding to the second connecting component 5, and a vertical part connected to the horizontal part and corresponding to combination of the rigid circuit board 4 and the first connecting component 3. The included angle between the horizontal part and the vertical part can be 90 degrees substantially.

It should be noticed that the reverse L-shaped structure of the connector structure 2 can substitute a conventional USB Type-C connector. For example, the rigid circuit board 4 can replace vertical extending parts of upper and lower terminals of the conventional USB Type-C connector. The first connecting component 3 whereon the rigid circuit board 4 is inserted can replace pins of upper and lower terminals of the conventional USB Type-C connector. Because the rigid circuit board 4 has controllable characteristic impedance, it can solve the problem of the conventional USB Type-C connector with instable high frequency signal transmission due to variation of characteristic impedance, especially for the vertically elongated conventional terminals. Besides, a height of the opening 551 of the second connecting component 5 can be adjusted flexibly by adjusting a length of the rigid circuit board 4, so as to satisfy various design demands.

In this embodiment, a distance between the upper surface 512 and a middle point of the upper surface 512 and the lower surface 513 is substantially equal to a distance between the lower surface 513 and the middle point of the upper surface 512 and the lower surface 513. A height difference H between the middle point of the upper surface 512 and the lower surface 513 and the circuit board 6 can be not less than 4.8 mm substantially, which can achieve electrical and mechanical effects by cooperation of the rigid circuit board 4 and the first connecting component 4. In other words, the rigid circuit board 4 and the first connecting component 3 might not be installed inside mechanical space of the vertical part of the reverse L-shaped structure by disposal of the height difference H less than 4.8 mm, resulting in affecting the integrated effect of the rigid circuit board 4 and the first connecting component 3. Similarly, a height difference between the middle point of the upper surface 512 and the lower surface 513 of the tongue plate 511 and the welding portion 322 of the first terminal 32 can be not less than 4.8 mm substantially, due to small height difference between the welding portion 322 of the first terminal 32 and the circuit board 6.

Figure 7:
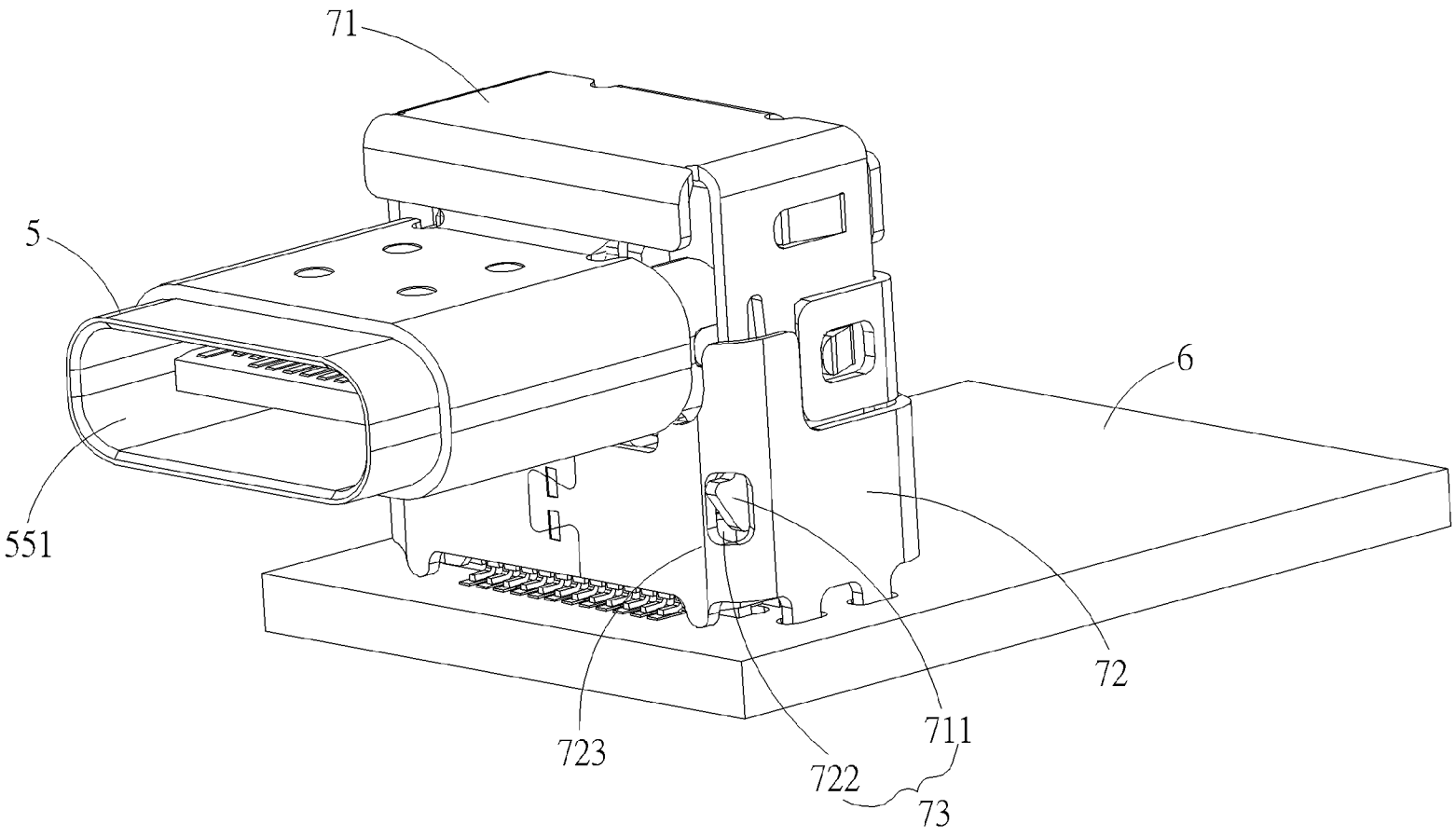
FIG. 7 is a schematic diagram of a connector structure installed on the circuit board according to another embodiment of the present invention.
Figure 8:
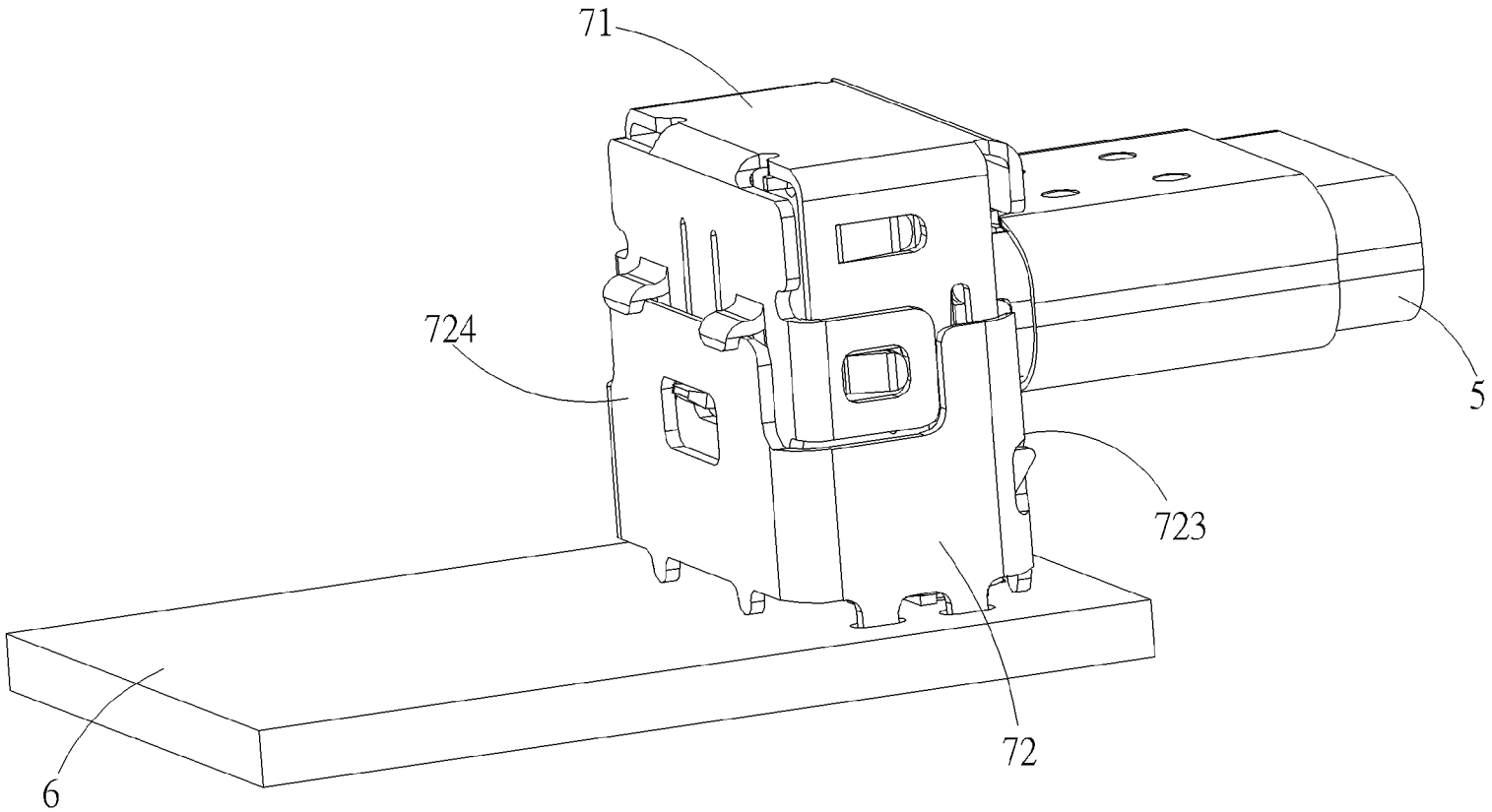
FIG. 8 is a schematic diagram of the connector structure installed on the circuit board at another view according to another embodiment of the present invention.
Figure 9:
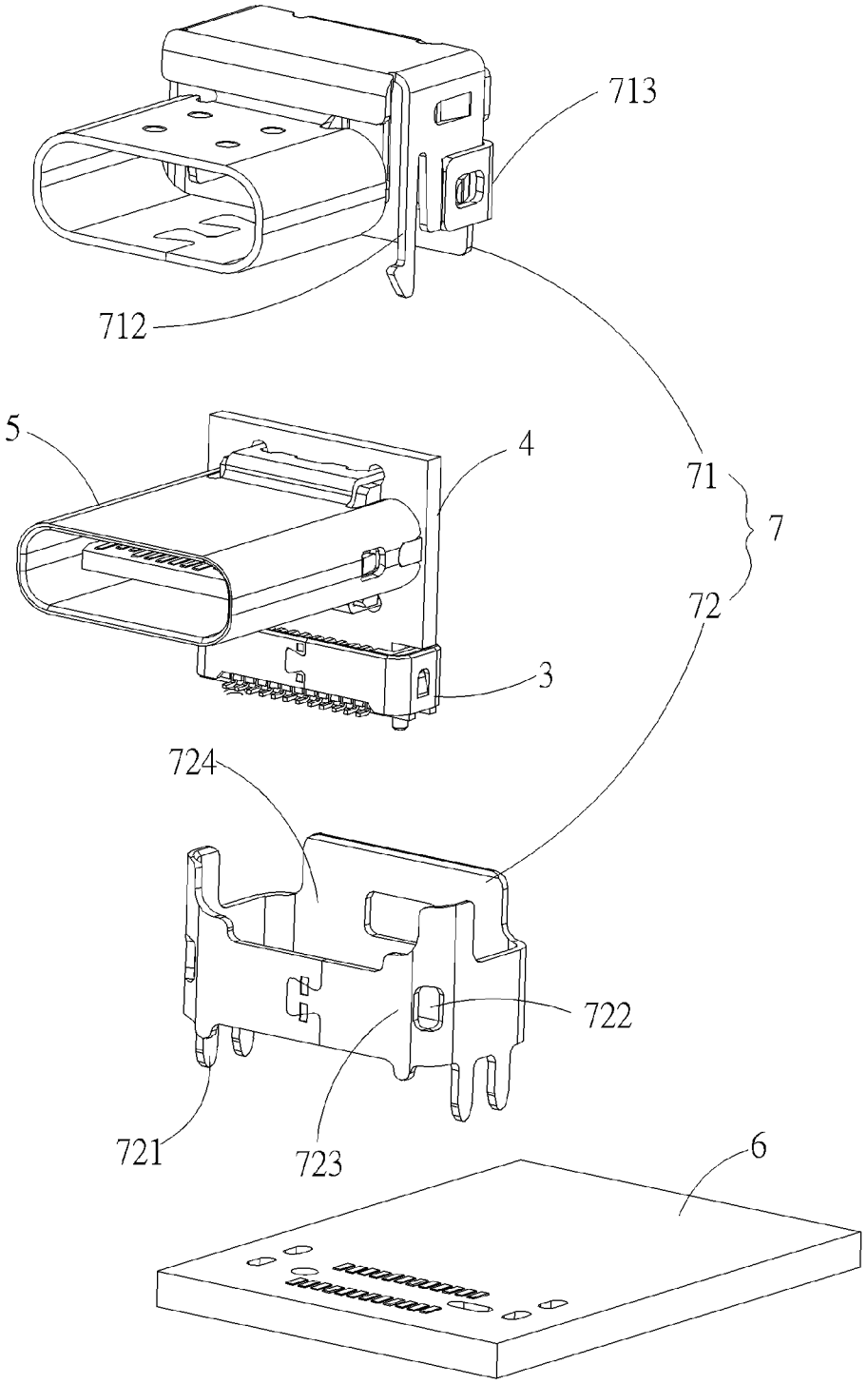
FIG. 9 is an exploded diagram of the connector structure according to another embodiment of the present invention.

Please refer to FIG. 7 to FIG. 9. FIG. 7 is a schematic diagram of a connector structure 2 installed on the circuit board 6 according to another embodiment of the present invention. FIG. 8 is a schematic diagram of the connector structure 2 installed on the circuit board 6 at another view according to another embodiment of the present invention. FIG. 9 is an exploded diagram of the connector structure 2 according to another embodiment of the present invention. The difference between this embodiment and the above-mentioned embodiment is that the connector structure 2 further includes a protecting structure 7 for protecting the second connecting component 5, the rigid circuit board 4 and the first connecting component 3, so as to prevent the structure and the relative positions therebetween from being damaged and being deformed by external force.

In this embodiment, the second connecting component 5, the rigid circuit board 4 and the first connecting component 3 are cooperatively formed in the reverse L-shaped structure. The rigid circuit board 4 connecting the second connecting component 5 and the first connecting component 3 might be damaged by the external force due to structural design of the reverse L-shaped structure, so the protecting structure 7 is utilized for covering the whole rigid circuit board 4, so as to protect the reverse L-shaped structure. Preferably, the protecting structure 7 can substantially cover the second connecting component 5, the rigid circuit board 4 and the first connecting component 3 entirely for avoiding deformation of the whole reverse L-shaped structure, which achieves an enhanced protecting effect.

It should be noticed that the protecting structure 7 can support and fasten the second connecting component 5 for providing a cushioning effect of dispersing the external force and preventing the second connecting component 5 and the rigid circuit board 4 from deformation by the excessive external force when the second connecting component 5 is connected with the butting connector, which is not shown in figures. Besides, the protecting structure 7 also can support and fasten the rigid circuit board 4 so as to protect the reverse L-shaped structure. The protecting structure 7 can be made of metal material. The protecting structure 7 includes an upper covering 71 for directly covering and fastening the second connecting component 5 and covering the rigid circuit board 4, and a lower covering 72 combined with the upper covering 71 and for covering the first connecting component 3. The lower covering 72 includes a plurality of welding legs 721 for welding on the circuit board 6. The protecting structure 7 further includes a fastening mechanism 73 for fastening the upper covering 71 and the lower covering 72. The fastening mechanism 73 can include a perforation disposed on one of the upper covering 71 and the lower covering 72, and a hook disposed on the other of the upper covering 71 and the lower covering 72 and for hooking the perforation. For example, the fastening mechanism 73 includes a perforation 722 disposed on the lower covering 72, and a hook 711 disposed on the upper covering 71 for hooking the perforation 722, so as to fasten the upper covering 71 with the lower covering 72.

In this embodiment, the lower covering 72 can be fixed on the circuit board 6 by welding the plurality of welding legs 721 on the circuit board 6. Then, the upper covering 71 can be assembled with the lower covering 72 via the fastening mechanism 73, and therefore the external force can be transmitted from the upper covering 71 to the lower covering 72 when the second connecting component 5 is connected with the butting connector, so as to protect the connector structure 2. The lower covering 72 includes a front baffle 723 and a rear baffle 724, and the upper covering 71 includes a front abutting portion 712 corresponding to the front baffle 723 and a rear abutting portion 713 corresponding to the rear baffle 724. The front abutting portion 712 abuts against the front baffle 723, and the rear abutting portion 713 abuts against the rear baffle 724, so that the front baffle 723 and the rear baffle 724 can block and constrain the front abutting portion 712 and the rear abutting portion 713, respectively.

Preferably, plate surfaces of the front baffle 723 and the rear baffle 724 of the lower covering 72 and the rear abutting portion 713 of the upper covering 71 can be perpendicular to an opening direction of the opening 551 on the side of the connecting chamber 55 of the second connecting component 5. That is, the normal directions of the plate surfaces of the front baffle 723 and the rear baffle 724 of the lower covering 72 and the rear abutting portion 713 of the upper covering 71 can be parallel with an inserting direction of the butting connector into the opening 551, so that the upper covering 71 and the lower covering 72 can cooperatively provide an enhanced supporting effect for the reverse L-shaped structure.

In contrast to the prior art, the connector structure of the present invention utilizes the rigid circuit board to replace vertical extending parts of upper and lower terminals of the conventional USB Type-C connector and utilizes the first connecting component whereon the rigid circuit board is inserted to replace pins of upper and lower terminals of the conventional USB Type-C connector. Because the rigid circuit board has controllable characteristic impedance, it can solve the problem of the conventional USB Type-C connector with instable high frequency signal transmission due to variation of characteristic impedance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A connector structure comprising:

a first connecting component comprising:

a first main body whereon a slot is formed;

a plurality of first terminals disposed on the first main body, each first terminal comprising:

a contacting portion extending into the slot; and a welding portion connected to the contacting portion and protruding out of the first main body;

a rigid circuit board assembling into the slot of the first main body, the rigid circuit board comprising:

an inserting portion inserting into the slot of the first main body, a plurality of first contacts being formed on the inserting portion and contacting the contacting portions of the plurality of first terminals respectively; and a supporting portion connected to the inserting portion, a plurality of second contacts being formed on the supporting portion and electrically connected to the plurality of first contacts respectively; and a second connecting component installed on the supporting portion of the rigid circuit board, the second connecting component comprising:

a second main body comprising a tongue plate having an upper surface and a lower surface opposite to each other;

a shielding plate disposed in the tongue plate and located between the upper surface and the lower surface of the tongue plate;

a plurality of second terminals disposed on the upper surface and the lower surface of the tongue plate and electrically connected to the plurality of second contacts; and a shell disposed around the tongue plate and defining a connecting chamber, an opening being formed on a side of the connecting chamber.

2. The connector structure of claim 1, wherein the second connecting component, the rigid circuit board and the first connecting component are formed in a reverse L-shaped structure having a horizontal part corresponding to the second connecting component, and a vertical part connected to the horizontal part and corresponding to the rigid circuit board and the first connecting component.

3. The connector structure of claim 2, further comprising a protecting structure for covering the rigid circuit board so as to protect the reverse L-shaped structure.

4. The connector structure of claim 3, wherein the protecting structure further covers the second connecting component and the first connecting component.

5. The connector structure of claim 4, wherein the protecting structure comprises:

an upper covering for covering the rigid circuit board and the second connecting component; and a lower covering combined with the upper covering and for covering the first connecting component, the lower covering comprising a plurality of welding legs for welding on a circuit board.

6. The connector structure of claim 5, wherein the protecting structure further comprises a fastening mechanism for fastening the upper covering and the lower covering.

7. The connector structure of claim 6, wherein the fastening mechanism comprises a perforation disposed on one of the upper covering and the lower covering, and a hook disposed on the other of the upper covering and the lower covering and for hooking the perforation.

8. The connector structure of claim 5, wherein the lower covering comprises a front baffle and a rear baffle, and the upper covering comprises a front abutting portion abutting against the front baffle and a rear abutting portion abutting against the rear baffle.

9. The connector structure of claim 8, wherein normal directions of plate surfaces of the front baffle, the rear baffle and the rear abutting portion are parallel with an inserting direction of a butting connector into the opening.

10. The connector structure of claim 2, wherein the welding portion of the first terminal is welded on a circuit board, and a height difference between a middle point of the upper surface and the lower surface of the tongue plate and the circuit board is not less than 4.8 mm.

11. The connector structure of claim 2, wherein a height difference between a middle point of the upper surface and the lower surface of the tongue plate and the welding portion of the first terminal is not less than 4.8 mm.

12. The connector structure of claim 2, further comprising a protecting structure for supporting and fastening the rigid circuit board so as to protect the reverse L-shaped structure.

13. The connector structure of claim 3, wherein the protecting structure further supports and fastens the second connecting component.

14. The connector structure of claim 1, wherein the rigid circuit board comprises a front surface, a rear surface and a ground layer disposed between the front surface and the rear surface, the plurality of second contacts is disposed on the front surface of the supporting portion, and the plurality of first contacts is disposed on the front surface and the rear surface of the inserting portion.

15. The connector structure of claim 1, wherein the first connecting component further comprises a shielding shell disposed around the first main body.

16. The connector structure of claim 1, further comprising a protecting structure for supporting and fastening the second connecting component.

17. The connector structure of claim 1, wherein the welding portion of the first terminal is welded on a circuit board, and a height difference between a middle point of the upper surface and the lower surface of the tongue plate and the circuit board is not less than 4.8 mm.

18. The connector structure of claim 1, wherein a height difference between a middle point of the upper surface and the lower surface of the tongue plate and the welding portion of the first terminal is not less than 4.8 mm.

19. The connector structure of claim 1, further comprising a protecting structure for supporting and fastening the rigid circuit board.

20. The connector structure of claim 1, further comprising a protecting structure for covering the rigid circuit board, the first connecting component and the second connecting component, so as to protect the connector structure.

* * * * *